US008771060B2

(12) United States Patent
Reddicks et al.

(10) Patent No.: US 8,771,060 B2
(45) Date of Patent: Jul. 8, 2014

(54) PROVIDING PROGRESSIVE GAMES FOR GAMING ENVIRONMENTS

(75) Inventors: Chris D. Reddicks, Reno, NV (US); Connie Louise Thome, Reno, NV (US); Jeremy J. Warner, Reno, NV (US)

(73) Assignee: IGT, Las Vegas, NV (US)

( * ) Notice: Subject to any disclaimer, the term of this patent is extended or adjusted under 35 U.S.C. 154(b) by 1148 days.

(21) Appl. No.: 11/690,666

(22) Filed: Mar. 23, 2007

(65) Prior Publication Data

US 2008/0234036 A1 Sep. 25, 2008

(51) Int. Cl.
*A63F 9/24* (2006.01)
*G07F 17/32* (2006.01)

(52) U.S. Cl.
CPC ..... *G07F 17/3258* (2013.01); *G07F 17/32* (2013.01); *G07F 17/3267* (2013.01); *G07F 17/3276* (2013.01)
USPC ..... 463/26; 463/16; 463/17; 463/18; 463/19; 463/20; 463/27; 463/42

(58) Field of Classification Search
USPC ..... 463/16–20, 40, 42, 26, 27, 424
See application file for complete search history.

(56) References Cited

U.S. PATENT DOCUMENTS

| | | | |
|---|---|---|---|
| 4,468,750 | A | 8/1984 | Chamoff et al. |
| 4,532,416 | A | 7/1985 | Berstein |
| 4,837,728 | A | 6/1989 | Barrie et al. |
| 4,856,787 | A | 8/1989 | Itkis |
| 4,868,900 | A | 9/1989 | Mcguire |
| 5,103,079 | A | 4/1992 | Barakai et al. |
| 5,116,055 | A | 5/1992 | Tracy |
| 5,149,945 | A | 9/1992 | Johnson et al. |
| 5,249,800 | A | 10/1993 | Hilgendorf et al. |
| 5,275,400 | A | 1/1994 | Weingardt et al. |

(Continued)

FOREIGN PATENT DOCUMENTS

| | | |
|---|---|---|
| AU | 199650576 | 4/1997 |
| AU | 754689 | 2/1999 |

(Continued)

OTHER PUBLICATIONS

International Search Report and Written Opinion of the International Searching Authority dated Jan. 19, 2009, for corresponding PCT Application No. PCT/US2008/057100.

(Continued)

*Primary Examiner* — Arthur Hall
(74) *Attorney, Agent, or Firm* — Foley & Lardner LLP

(57) ABSTRACT

Techniques for providing progressive games in a gaming environment are disclosed. Progressive configuration data can effectively define one or more progressive games for a gaming environment that includes one or more gaming machines. The progressive gaming data can, for example, be provided as a set of rules (e.g., rules in an XSLT form). A progressive configurator uses the progressive configuration data and gaming data received from the gaming machines in order to effectively implement one or more progressive games. The gaming data can, for example, include information about a gaming machine (e.g., serial number, network, location), one or more games available on the gaming machine (e.g., type of the game, minimum and maximum bet for a game), and data regarding a specific game instance (e.g., amount wagered, outcome of a game instance). In addition, the amount of contribution to a progressive game, whether there is a win, and/or prize to be rewarded can be determined by the progressive configurator and/or a progressive gaming manager.

25 Claims, 12 Drawing Sheets

(56) References Cited

U.S. PATENT DOCUMENTS 5,280,909 A 1/1994 Tracy
5,286,023 A 2/1994 Wood
5,288,077 A 2/1994 Jones
5,344,144 A 9/1994 Canon
5,364,105 A 11/1994 Jones
5,380,008 A 1/1995 Mathis et al.
5,401,023 A 3/1995 Wood
5,401,024 A 3/1995 Simunek
5,466,920 A 11/1995 Nair et al.
5,472,194 A 12/1995 Breeding et al.
5,491,812 A 2/1996 Pisello et al.
5,580,309 A 12/1996 Piechowiak et al.
5,605,334 A 2/1997 McCrea, Jr.
5,611,730 A 3/1997 Weiss
5,643,086 A 7/1997 Alcorn et al.
5,651,548 A 7/1997 French et al.
5,655,961 A 8/1997 Acres et al.
5,684,750 A 11/1997 Kondoh et al.
5,702,304 A 12/1997 Acres et al.
5,707,287 A 1/1998 McCrea, Jr.
5,735,742 A 4/1998 French
5,743,798 A 4/1998 Adams et al.
5,761,647 A 6/1998 Boushy
5,766,076 A 6/1998 Pease et al.
5,781,647 A 7/1998 Fishbine et al.
5,819,107 A 10/1998 Lichtman et al.
5,820,459 A 10/1998 Acres et al.
5,851,148 A 12/1998 Brune et al.
5,885,158 A * 3/1999 Torango et al. ..... 463/27
5,941,769 A 8/1999 Order
6,003,013 A 12/1999 Boushy et al.
6,015,347 A 1/2000 Maahs et al.
6,033,307 A 3/2000 Vancura
6,080,062 A 6/2000 Olson
6,104,815 A 8/2000 Alcorn et al.
6,106,396 A 8/2000 Alcorn et al.
6,110,043 A 8/2000 Olsen
6,113,492 A 9/2000 Walker et al.
6,135,884 A 10/2000 Hedrick et al.
6,135,887 A 10/2000 Pease et al.
6,149,522 A 11/2000 Alcorn et al.
6,183,362 B1 2/2001 Boushy
6,193,152 B1 2/2001 Fernando et al.
6,193,607 B1 2/2001 Kay
6,217,448 B1 4/2001 Olsen
6,231,442 B1 5/2001 Mayeroff
6,241,608 B1 6/2001 Torango et al.
6,264,561 B1 7/2001 Saffari et al.
6,302,793 B1 10/2001 Fertitta, III et al.
6,306,035 B1 10/2001 Kelly et al.
6,313,871 B1 11/2001 Schubert
6,336,863 B1 1/2002 Baerlocher et al.
6,346,044 B1 2/2002 McCrea, Jr.
6,358,149 B1 3/2002 Schneider et al.
6,368,216 B1 4/2002 Hedrick et al.
6,371,852 B1 4/2002 Acres
6,409,595 B1 6/2002 Uihlein et al.
6,425,824 B1 7/2002 Baerlocher et al.
6,454,648 B1 9/2002 Kelly et al.
6,474,649 B1 11/2002 Kennedy et al.
6,532,297 B1 3/2003 Lindquist
6,592,458 B1 7/2003 Ho
6,592,460 B2 7/2003 Torango et al.
6,607,439 B2 8/2003 Schneier et al.
6,645,077 B2 11/2003 Rowe
6,663,490 B2 12/2003 Soltys et al.
6,682,423 B2 1/2004 Brosnan et al.
6,684,195 B1 1/2004 Deaton et al.
6,685,567 B2 2/2004 Cockerille et al.
6,776,715 B2 8/2004 Price
6,804,763 B1 10/2004 Stockdale et al.
6,857,959 B1 2/2005 Nguyen
6,863,608 B1 3/2005 LeMay et al.
6,866,586 B2 3/2005 Oberberger et al.
6,939,234 B2 * 9/2005 Beatty ..... 463/42
6,960,134 B2 11/2005 Hartl et al.
6,984,174 B2 1/2006 Cannon et al.
7,111,141 B2 9/2006 Nelson
7,127,069 B2 10/2006 Nguyen
7,329,183 B2 2/2008 Michaelson et al.
7,384,336 B2 6/2008 Torango
7,384,339 B2 6/2008 LeMay et al.
7,455,591 B2 11/2008 Nguyen
7,997,981 B2 8/2011 Rowe et al.
2001/0038178 A1 11/2001 Vancura
2001/0053712 A1 12/2001 Yoseloff et al.
2002/0071557 A1 6/2002 Nguyen
2002/0077178 A1 6/2002 Oberberger et al.
2002/0143626 A1 10/2002 Voltmer et al.
2003/0022714 A1 1/2003 Oliver
2003/0060279 A1 3/2003 Torango et al.
2003/0064798 A1 4/2003 Grauzer et al.
2003/0092484 A1 5/2003 Schneider et al.
2003/0104853 A1 6/2003 Tessmer et al.
2003/0104860 A1 6/2003 Cannon et al.
2003/0148808 A1 8/2003 Price
2003/0162591 A1 8/2003 Nguyen et al.
2003/0181231 A1 9/2003 Vancura et al.
2003/0211883 A1 11/2003 Potts
2004/0002385 A1 1/2004 Nguyen
2004/0038735 A1 2/2004 Steil et al.
2004/0066278 A1 4/2004 Hughes et al.
2004/0087368 A1 5/2004 Gauselmann
2004/0142740 A1 7/2004 Damico et al.
2004/0142750 A1 * 7/2004 Glisson et al. ..... 463/42
2004/0152511 A1 8/2004 Nicely et al.
2004/0166923 A1 8/2004 Michaelson et al.
2004/0166940 A1 * 8/2004 Rothschild ..... 463/42
2004/0266533 A1 * 12/2004 Gentles et al. ..... 463/42
2005/0020354 A1 1/2005 Nguyen et al.
2005/0037837 A1 2/2005 Rowe
2005/0043086 A1 2/2005 Schneider
2005/0054438 A1 3/2005 Rothschild et al.
2005/0054448 A1 * 3/2005 Frerking et al. ..... 463/42
2005/0059472 A1 3/2005 Joshi et al.
2005/0059481 A1 3/2005 Joshi et al.
2005/0096130 A1 5/2005 Mullins
2005/0113172 A1 * 5/2005 Gong ..... 463/42
2005/0209004 A1 * 9/2005 Torango ..... 463/42
2005/0239542 A1 10/2005 Olsen
2006/0035694 A1 2/2006 Fuller
2006/0040736 A1 2/2006 Baerlocher et al.
2006/0040743 A1 2/2006 Saffari et al.
2006/0052162 A1 * 3/2006 Soukup et al. ..... 463/27
2006/0073887 A1 4/2006 Nguyen et al.
2006/0073889 A1 4/2006 Edidin et al.
2006/0073897 A1 4/2006 Englman et al.
2006/0100008 A1 5/2006 Wright et al.
2006/0142086 A1 * 6/2006 Blackburn et al. ..... 463/42
2006/0154718 A1 * 7/2006 Willyard et al. ..... 463/25
2006/0183537 A1 * 8/2006 Dickerson ..... 463/27
2006/0247035 A1 11/2006 Rowe et al.
2006/0252501 A1 11/2006 Little et al.
2006/0264256 A1 * 11/2006 Gagner et al. ..... 463/20
2007/0060237 A1 3/2007 Rowe et al.
2007/0060311 A1 3/2007 Rowe et al.
2007/0060320 A1 * 3/2007 Kelly et al. ..... 463/27
2007/0106553 A1 5/2007 Jordan et al.
2007/0155490 A1 * 7/2007 Phillips et al. ..... 463/29
2007/0298873 A1 12/2007 Nguyen et al.
2008/0058059 A1 * 3/2008 Fitzsimons et al. ..... 463/20
2008/0090653 A1 * 4/2008 Kuehling et al. ..... 463/29
2008/0318685 A9 * 12/2008 Oak et al. ..... 463/42
2009/0270168 A1 * 10/2009 Englman et al. ..... 463/27

FOREIGN PATENT DOCUMENTS

AU 766341 1/2002
EP 0 769 769 4/1997
EP 1 211 630 6/2002
EP 1 380 998 1/2004
EP 1 528 514 5/2005
EP 1 554 021 7/2005
EP 1 632 913 3/2008

(56) References Cited

FOREIGN PATENT DOCUMENTS

| | | |
|---|---|---|
| EP | 1 938 288 | 7/2008 |
| JP | 2003-279648 | 10/2003 |
| WO | WO 96/06409 | 2/1996 |
| WO | WO 96/36253 | 11/1996 |
| WO | WO 97/44750 | 11/1997 |
| WO | WO 00/16289 | 3/2000 |
| WO | WO 00/22585 | 4/2000 |
| WO | WO 02/077939 | 10/2002 |
| WO | WO 2004/027584 | 4/2004 |
| WO | WO 2004/088604 | 10/2004 |
| WO | WO 2005/022443 | 3/2005 |
| WO | WO 2005/105235 | 11/2005 |
| WO | WO 2006/023681 | 3/2006 |
| WO | WO 2006/037220 | 4/2006 |
| WO | WO 2007/032954 | 3/2007 |
| WO | WO 2007/145999 | 12/2007 |
| WO | WO 2007/149180 | 12/2007 |
| WO | 2008/118665 | 10/2008 |

OTHER PUBLICATIONS

"Extensible Markup Language," Wikipedia, the free encyclopedia, 14 pages, http://en.wikipedia.org/wiki/XsIt.
"XSL Transformations," Wikipedia, the free encyclopedia, 9 pages, http://en.wikipedia.org/wiki/XsIt.
Australian Examiner's report No. 2 dated May 8, 2012 issued in AU 2007258661.
Chinese First Office Action dated Jun. 12, 2010 issued in CN 200780027102.0.
Chinese Second Office Action dated Mar. 10, 2011 issued in CN 200780027102.0.
European Examination Report dated Oct. 5, 2009 issued in EP 07 809 360.6-1238.
Wang et al., "Casino Technology: Player Tracking and Slot Accounting Systems", (Abstract) *UNLV Gaining Research & Review Journal*, Univ. Nevada, 6(1):43-56.
U.S. Appl. No. 09/642,192, filed Aug. 18, 2000, LeMay et al.
U.S. Appl. No. 11/225,299, filed Sep. 12, 2005, Rowe et al.
US Office Action dated Apr. 2, 2008 issued in U.S. Appl. No. 10/923,333.
US Office Action Final dated Oct. 21, 2008 issued in U.S. Appl. No. 10/923,333.
US Office Action dated Apr. 27, 2009 issued in U.S. Appl. No. 10/923,333.
US Office Action Final dated Nov. 20, 2009 issued in U.S. Appl. No. 10/923,333.
US Office Action dated Jul. 14, 2010 issued in U.S. Appl. No. 10/923,333.
US Office Action Final dated Dec. 17, 2010 issued in U.S. Appl. No. 10/923,333.
US Notice of Panel Decision from Pre-Appeal Brief Review dated Apr. 27, 2011 issued in U.S. Appl. No. 10/923,333.
US Office Action dated Jul. 8, 2011 issued in U.S. Appl. No. 10/923,333.
US Office Action Final dated Jan. 20, 2012 issued in U.S. Appl. No. 10/923,333.
US Office Action dated Mar. 31, 2009 issued in U.S. Appl. No. 11/449,985.
US Office Action Final dated Mar. 3, 2010 issued in U.S. Appl. No. 11/449,985.
US Office Action dated Aug. 9, 2010 issued in U.S. Appl. No. 11/449,985.
US Office Action Final dated Mar. 7, 2011 issued in U.S. Appl. No. 11/449,985.
US Office Action dated Mar. 6, 2012 issued in U.S. Appl. No. 11/449,985.
US Office Action dated Jul. 18, 2007 issued in U.S. Appl. No. 11/225,299.
US Office Action Final dated Jan. 8, 2008 issued in U.S. Appl. No. 11/225,299.
US Office Action dated Jun. 11, 2008 for U.S. Appl. No. 11/225,299.
US Office Action Final dated Dec. 9, 2008 issued in U.S. Appl. No. 11/225,299.
US Office Action dated Jun. 24, 2009 for U.S. Appl. No. 11/225,299.
US Petition Decision dated Oct. 16, 2009 for U.S. Appl. No. 11/225,299.
US Office Action Final dated Oct. 15, 2010 issued in U.S. Appl. No. 11/225,299.
US Office Action dated Jan. 10, 2011 issued in U.S. Appl. No. 11/225,299.
US Notice of Allowance dated Apr. 15, 2011 issued in U.S. Appl. No. 11/225,299.
US Notice of Allowance dated Jun. 14, 2011 issued in U.S. Appl. No. 11/225,299.
PCT International Search Report dated Jan. 12, 2006 issued in PCT/US2005/029465 (WO2006/23681).
PCT Written Opinion dated Jan. 12, 2006 issued in PCT/US2005/029465 (WO2006/23681).
PCT International Preliminary Report on Patentability and Written Opinion dated Feb. 20, 2007 issued in PCT/US2005/029465 (WO2006/23681).
PCT International Search Report dated Dec. 13, 2007 issued in PCT/US2007/013325 (WO2007/145999).
PCT International Preliminary Report on Patentability and Written Opinion dated Dec. 10, 2008 issued in PCT/US2007/013325 (WO2007/145999).
Australian Examiner's first report dated Jun. 27, 2011 issued in AU 2007258661.

* cited by examiner

Sample rules code:

```
<PrizeGroup GroupNum = “2” Name = “Vland” Local = “Y”>
<Description>
<![CDATAC[
a play on any WOF game in VLand with $1 denom contributes to the group.
  any wager can win a scaled jackpot
  ]]>
  </Description>
<BingoServerList>
<BingoServer>l</Bingoserver>
<BingoServer>2</BIngoServer>
<BIngoServer>3</BingoServer>
<BingoServer>4</BingoServer>
<BIngoServer>5</BIngoServer>
  </BingoServerList>
<GroupCtb>
<RsvCtbRate>3.5</RsvCtbRate>
<MaxExpectedWgr>22.50>/MaxExpectedWgr>
  </GroupCtb>
  <CtbRule>

<PrizeConflg Rev = “A” Signature = “63A5213” Serial = “567890”>
<PrizeGroup GroupNum = “1” Name + “WOF WAP xxx” Local = “N”
  HighestWinnerPaid="Y">
<Description>
<![CDATA[
a play on any wof game with $1 denom will contribute to this group.  $3 wager
  can win non-scaled primary. any wager < $3 can win a scaled secondary
  ]]>
  </Description>
  <! --
  no defaults
  -->

<PrizeGroup GroupMum= “3” Name= “SuperStepper” Local= “N”>
  <Description>
  < ! [CDATA[
a play on any stepper game with $5 or over wager(regard1ess denom)
contributes to the group and is eligible for a scaled jackpot
  ]]>
  </Description>
```

702

704

Figure 7A

```
<PrizeGroup GroupMum= “5” Name= “SpecialGarnes” Local= “N”>
  <Description>
  <! [CDATA[
any play on the special 4 games on server 1 or 10 with wager $1 in denom 5c or
  10c contributes to the group, and is eligible for a non-scaled jackpot
  ]]>
  </Description>
<BingoServerList>
<Bingoserver> 1 </Bingoserver>
<Bingoserver> l0 </BingoServer>
  </BingoServerList>
<GroupCtb>
<RsvCtbRate>3.5</RsvCtbRate>
<MaxExpectedWgr>22.50</MaxExpectedWgr>
  </GroupCtb>
<CtbRule>
< ![CDATA[
<xsl:if test = “(serial = 1111111 or
                serial = 2222222 or
                serial = 4444444 or
                serial 1 5555555) and
                wgr = 1.00 and denom >= 0.05 and denom & lt; = 0.1”>
        <xsl:copy-of select = “mach_id” />
        </xsl : if>
  ]]>
  </CtbRule>
<Prize PrizeNum = “1” Name = “Prlmary” Odds = “10000:1”>
<Accounting>
<Base> 100000,00</Base>
<CtbRate>l.5</CtbRate>
  </Accountjng>
<AwardRule>
<BingoPattern Balls= “10”>7, 9, 13, 17, 18, 19</BingoPattern>
```

Figure 7B

PROVIDING PROGRESSIVE GAMES FOR GAMING ENVIRONMENTS

BACKGROUND OF THE INVENTION

Typically, utilizing a master gaming controller, a gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate game play. These steps require the gaming machine to control input devices, such as bill validators and coin acceptors, to accept money into the gaming machine and recognize user inputs from devices, including key pads, button pads, card readers, and ticket readers, to determine the wager amount, and initiate game play. After game play has been initiated, the gaming machine determines a game outcome, presents the game outcome to the player and may dispense an award of some type depending on the outcome of the game. The operations described above may be carried out on the gaming machine when the gaming machine is operating as a "stand alone" unit or linked in a network of some type to a group of gaming machines.

As technology in the gaming industry progresses, more and more gaming services are being provided to gaming machines via communication networks that link groups of gaming machines to a remote computer, such as a host server, that provides one or more gaming services. As an example, gaming services that may be provided by a remote computer to a gaming machine via a communication network of some type include player tracking, accounting, cashless award ticketing, lottery, progressive games, and bonus games or prizes. These services and features are provided in addition to the games that are available for play on the gaming machines.

In a progressive system, a plurality of gaming machines can be linked together. A percentage of game play on each gaming machine can then be used to determine a progressive jackpot value. The progressive jackpot value is typically determined by a central server in communication with each of the linked gaming machines. The central server updates the progressive jackpot value as it receives information regarding game play on the linked gaming machines and broadcasts this progressive jackpot value to the linked gaming machines.

The progressive jackpot value usually begins at some predefined value and continually increases until a win or a hit occurs at one of the linked gaming machines in the progressive system. After a win, the progressive jackpot is paid out at the machine showing the hit jackpot and the system resets to the pre-defined value and begins incrementing again. This procedure then repeats as jackpots are won and game play continues.

One type of progressive system links gaming machines spread out over many locations, such as gaming machines in stores, casinos and airports distributed throughout the state of Nevada. This type of system is typically referred to as a "wide area progressive" (WAP) system and a jackpot on this type of system is referred to as a wide area progressive (WAP) jackpot. A WAP system can link thousands of gaming machines and the WAP jackpot can reach values that are in the hundreds of thousands of dollars or millions of dollars.

In Nevada, there are many different WAP systems. The WAP systems are independent of one another such that a gaming machine is hooked to only one WAP system at any one time. Thus, a gaming machine hooked to a particular WAP system is allowed to provide only the progressive jackpots that are available on its system.

SUMMARY OF THE INVENTION

Broadly speaking, the invention relates to techniques for providing progressive games. One or more progressive games can be provided for a gaming environment that includes one or more gaming machines (or units) operable for playing one or more games.

In accordance with one aspect of the invention, progressive configuration data can effectively define one or more progressive games for a gaming environment. The progressive gaming data can, for example, be provided as a set of rules (e.g., rules in an XSLT form) and/or in an editable form to allow a human (e.g., administrator) to create and modify it in a convenient manner as needed. In accordance with one embodiment, a progressive configurator can use the progressive configuration data to effectively implement one or more progressive games. The progressive configurator can, for example, be provided by a gaming server that serves a plurality of gaming machines in a gaming environment. The gaming machines can send gaming data to the progressive configurator to allow the progressive configurator to determine whether each gaming machine is eligible to participate in one or more progressive games defined by the progressive configurator data. The gaming data can, for example, include information about a gaming machine (e.g., serial number, network, location), one or more games available on the gaming machine (e.g., type of the game, minimum and maximum bet for a game), and gaming data regarding a specific game instance (e.g., amount wagered, outcome of a game instance).

In one embodiment, the gaming machines initially report a set of parameters that effectively indicate their gaming capabilities and parameters (e.g., type of game available, probability of success for a game, minimum and maximum wagers allowed for a games). Based on the initial gaming data, an administrator can generate progressive configuration data that effectively defines one or more progressive games for the gaming machines. The progressive configuration data is then provided to a gaming server that effectively provides a progressive configurator for the gaming machines. The progressive configurator determines whether each of the gaming machines is eligible to participate in one or more progressive games defined by the progressive configuration data. If a gaming machine is eligible to participate in a progressive game, the progressive configurator can effectively wait for a qualifying bet to be made. In accordance with one embodiment, a gaming machine reports the qualifying bet to the progressive configurator when a wager has been made. The progressive configurator can then determine that a particular instance of a game played on the gaming machine can participate in playing one or more progressive games. In addition, the amount of contribution to a progressive game and/or whether there is a win and/or prize amount can be determined by the progressive configurator and/or a progressive gaming manager in communication with the progressive configurator. Furthermore, the progressive gaming manager can be configured to effectively manage one or more progressive games for the gaming environment by providing administrative and accounting functionality.

The invention can be implemented in numerous ways, including, for example, a method, an apparatus, a computer readable medium, and a computing device. Several Exemplary embodiments of the invention are discussed below.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which:

FIGS. 7A and 7B depict exemplary progressive rules in accordance with one embodiment of the invention.

DETAILED DESCRIPTION OF THE INVENTION

Figure 1:
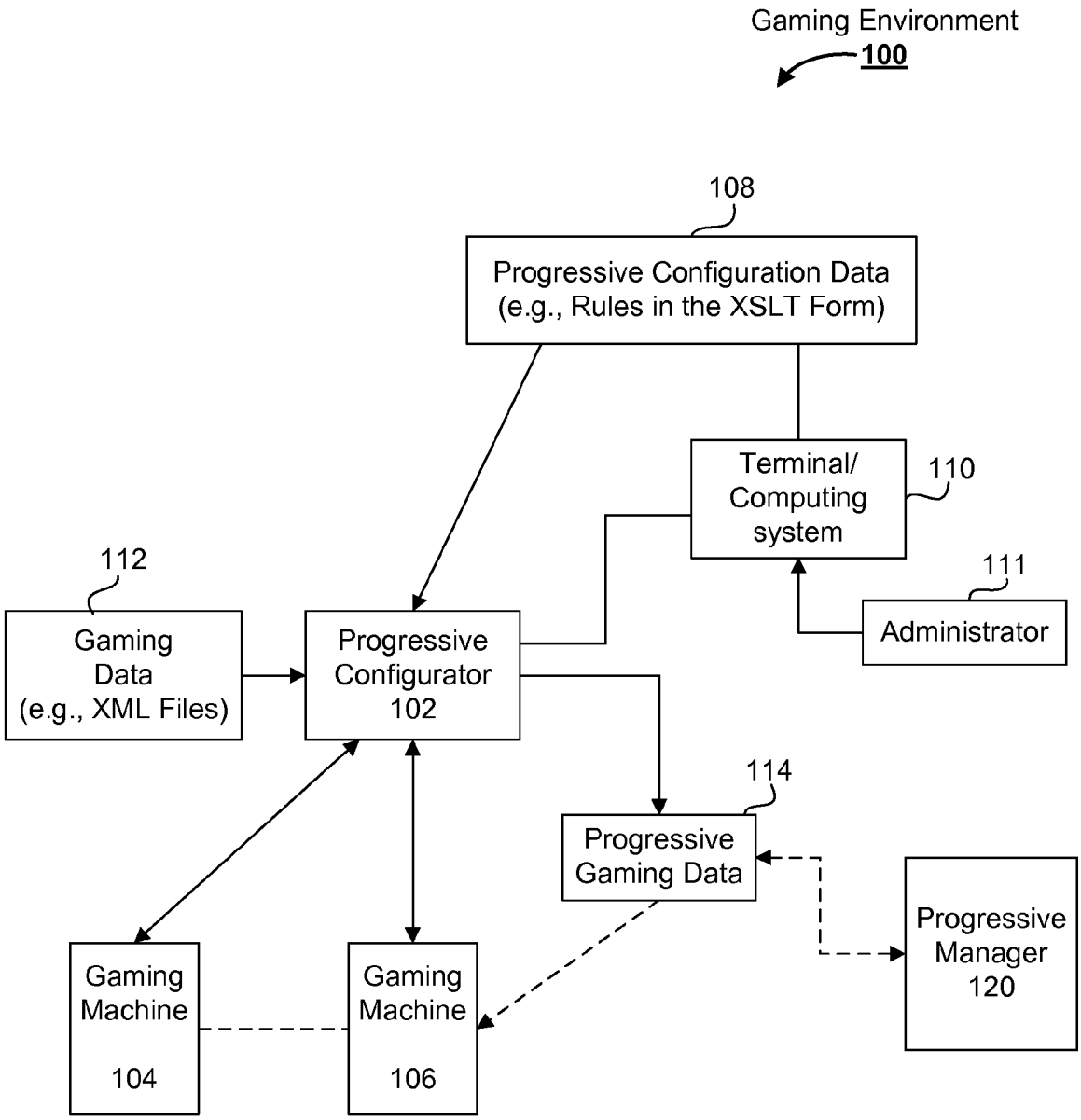
FIG. 1 depicts a gaming-environment in accordance with one embodiment of the invention.

As noted in the background section, progressive games have become popular. Conventionally, a gaming machine can be configured to participate in a progressive game. However, configuring a gaming machine to participate can be cumbersome and can generally lead to static configurations that is often difficult to implement and modify. These problems are especially pronounced in modern gaming environment when many gaming machines can be configured for a gaming environment, new machines and games are often added, old machines are replaced and/or upgraded, and several games may be available on each gaming machine in a gaming environment that games can be downloaded as needed. Accordingly, improved techniques for providing progressive games in a gaming environment would be useful.

The invention pertains to techniques for providing progressive games in a gaming environment that can include one or more gaming machines (or units) operable for playing one or more games. In accordance with one aspect of the invention, progressive configuration data can effectively define one or more progressive games for a gaming environment. The progressive gaming data can, for example, be provided as a set of rules (e.g., rules in an XSLT form) and/or in an editable form to allow a human (e.g., administrator) to create and modify it in a convenient manner as needed. In accordance with one embodiment, a progressive configurator can use the progressive configuration data to effectively implement one or more progressive games. The progressive configurator can, for example, be provided by a gaming server that serves a plurality of gaming machines in a gaming environment. The gaming machines can send gaming data to the progressive configurator to allow the progressive configurator to determine whether each gaming machine is eligible to participate in a progressive game defined by the progressive configurator data. The gaming data can, for example, include information about a gaming machine (e.g., serial number, network, location), games available on the gaming machine (e.g., type of games available, minimum and maximum bet for each game available), and gaming data regarding a specific game instance (e.g., amount wagered, outcome of a game instance). In one embodiment, the gaming machines initially report a set of parameters that effectively indicate their gaming capabilities and parameters (e.g., type of game available, probability of success for a game, minimum and maximum wagers allowed for a games). Based on the initial gaming data, an administrator can generate progressive configuration data that effectively defines one or more progressive games for the gaming machines. The progressive configuration data is then provided to a gaming server that effectively provides a progressive configurator for the gaming machines.

It will be appreciated that the progressive configurator can determine whether each gaming machine is eligible to participate in one or more progressive games defined by the progressive configuration data. If a gaming machine is eligible to participate in a progressive game, the progressive configurator can effectively wait for a qualifying bet to be made. In one embodiment, a gaming machine reports the qualifying bet to the progressive configurator when a wager has been made. The progressive configurator can then determine that a particular instance of a game played on the gaming machine can participate in one or more progressive games (e.g., contribution to a progressive prize and/or win a progressive prize). In addition, the amount of contribution to a progressive prize, whether there is a win and/or the prize amount to be awarded can be determined by the progressive configurator and/or a progressive gaming manager in communication with the progressive configurator. The progressive gaming manager can be configured to effectively manage one or more progressive games for the gaming environment by providing administrative and accounting functionality.

Embodiments of these aspects of the invention are discussed below with reference to FIGS. 1-9. However, those skilled in the art will readily appreciate that the detailed description given herein with respect to these figures is for explanatory purposes as the invention extends beyond these limited embodiments.

FIG. 1 depicts a gaming-environment 100 in accordance with one embodiment of the invention. Referring to FIG. 1, a progressive configurator 102 can communicate with the gaming machines 104 and 106. The gaming machines 104 and 106, for example, can be connected to each other in the same network and/or be located in the same casino floors. Alternatively, the gaming machines 104 and 106 can be in different graphical locations, networks and/or casinos. In any case, the progressive configurator 102 can facilitate playing one or more progressive games for the gaming machine 104 and/or 106. In other words, the progressive gaming configurator 102 can effectively implement one or more progressive games where one or both of the gaming machines 104 and 106 can be eligible to play a progressive game and win one or more progressive prizes. It will be appreciated that neither of the gaming machines 104 and 106 need to be configured for a progressive game. In effect, the gaming machines 104 and 106 need not be aware that they can or are participating in a progressive game.

More particularly, the progressive gaming configurator 102 can use progressive configuration data 108 in order to effectively implement one or more progressive games for the gaming environment 100. It will be appreciated that the progressive configuration data 108 can effectively define one or more progressive games including one or more progressive prizes for each of the progressive games that it defines. The progressive configuration data 108 can be received, selected, identified and/or determined by the progressive gaming configurator 102. Typically, the progressive configuration data 108 is provided as input to the progressive configurator 102 and subsequently processed by the progressive configurator 102 to effectively implement one or more progressive games based on the definitions effectively provided by the progressive configuration data 108 for the gaming environment 100.

In one embodiment, the progressive configuration data 108 includes a set of rules that effectively define one or more progressive games and/or progressive prizes (e.g., rules expressed in an XSLT form or format). In one embodiment, rules are provided in a XSLT form. As known in the art, Extensible Stylesheet Language Transformations (or XSLT) is an XML language used for the transformation of XML documents. The original document is not changed; rather, a new document is created based on the content of an existing one. The new document may be serialized (output) by the processor in standard XML syntax or in another format, such as HTML or plain text. XSLT is most often used to convert data between different XML schemas or to convert XML data into web pages or PDF documents. The Extensible Markup Language (XML) is a W3C-recommended general-purpose markup language for creating special-purpose markup languages, capable of describing many different kinds of data. In other words, XML is a way of describing data and an XML file can contain the data too, as in a database. It is a simplified subset of Standard Generalized Markup Language (SGML). Its primary purpose is to facilitate the sharing of data across different systems, particularly systems connected via the Internet. Languages based on XML (for example, Geography Markup Language (GML), RDF/XML, RSS, Atom, MathML. XHTML. SVG, Klip and MusicXML) are defined in a formal way, allowing programs to modify and validate documents in these languages without prior knowledge of their particular form.

In general, the progressive configuration data 108 can effectively define, describe and/or specify one or more progressive games and their associated prizes for the gaming environment 100. As such, those skilled in the art will readily appreciate that the progressive configuration data 108 can be provided in numerous forms and formats using various techniques (e.g., data stored as records in a database, configuration files stored in an editable format). The progressive configuration data 108 can, for example, be generated and/or modified by an administrator 111 using a terminal and/or computing system 110 which can be in communication with the progressive configurator 102 and/or another computing system or storage (not shown) where the progressive configuration data 108 can be stored. In any case, the progressive configurator 102 can effectively use the progressive configuration data 108 to provide one or more progressive games for the gaming environment 100.

In addition to the progressive configuration data 108, gaming data 112 can be used by the progressive configurator 102 in order to effectively provide and/or implement one or more progressive games for the gaming environment 100. In general, the gaming data 112 can provide information about gaming machines 104 and 106, the games available on them, as well as data associated with gaming instances of games played on the gaming machines 104 and 106. As such, the gaming data 112 can, for example, include data pertaining to characteristics and/or capabilities of a particular gaming machine and/or one or more games available on the gaming machine (or gaming machine specific data). Gaming machine specific data can, for example, be provided as one or more static data parameters (e.g., serial number, hardware capabilities, denominations available for game play, games currently available). The gaming data 112 can also include data associated with game play or a particular game instance which can be provided in real time as the game is being played. This type of data can, for example, be provided as one or more dynamic data parameters (e.g., amount of the current wager, outcome of the game). The gaming data 112 can, for example, be provided in an XML form and/or format. Those skilled in the art will appreciate that gaming data can, for example include one or more of the following: an identification name and/or number, a location, a manufacturer, a serial number, a group and/or bank ID, denominations available for game play, games available, progressive triggers, progressive win categories, progressive pay combinations, possibilities of progressive outcomes, base credits wagered, bet amounts, number of line played, links available, and themes available.

It will be appreciated that the progressive configurator 102 can use the progressive configuration data 108 and/or gaming data 112 in order to allow the gaming machines 104 and 106 to participate in one or more progressive games. Typically, the progressive configurator 102 uses both progressive configuration data 108 and gaming data 112 to effectively facilitate and/or implement a progressive game. By way of example, progressive configuration data 108 can be used to determine whether the gaming machine 104 is eligible to participate in a first progressive game when a wager of at least a first amount (e.g., $5.00) has been made for a particular game (e.g., bingo). In other words, progressive configuration data 108 can, for example, define the first progressive game as a bingo game with a wager of at least $5.00. The gaming machine 104 may effectively report to the progressive configurator 102 that it is operable for the bingo game and offers a wager of $5.00 or higher (e.g., gaming machine 104 can send the progressive configurator 102 one or more data parameters indicating that it offers a wager of $5.00 or higher). Subsequently, gaming data relating to game played or being played on the gaming machine 104 a can be sent to the progressive configurator 102 (e.g., when a player makes a wager of $5.00 or higher on a bingo game on the gaming machine 104, one or more parameters can be sent by the gaming machine 104 to the progressive configurator 102). The progressive configurator 102 can then determine that a qualifying bet has been made which can participate and win one or more progressive prizes, thereby effectively implementing a progressive game for the gaming environment 100. It should be noted that this determination can generally be made by the progressive configurator 102 based on the progressive configuration data 108 and additionally based on the gaming data 112 if there is a need. In some cases there may not be a need for gaming data 112 (e.g., progressive configuration data 108 can effectively allow all bets made on a particular gaming machine to contribute to a progressive prize.

It should be noted that progressive configurator 102 can also determine and/or receive progressive gaming data 114 relating to the one or more progressive games effectively defined by the progressive configuration data 108 and provided for the gaming environment 100. The progressive data 114 can, for example, provide the outcome of a progressive game, update a progressive prize, and indicate the amount of a progressive prize to be awarded. As such, the progressive gaming data 114 can be provided to the gaming machines 104 and 106 in order to effectively manage a progressive game. It should be noted that a progressive manager 120 can effectively manage one or more progressive games for the gaming environment 100 and can be in communication with the progressive configurator 102. The progressive manager 120 can at least manage some aspects of a progressive game, or effectively manage the progressive game entirely. Hence, a progressive game can be effectively managed by the progressive configurator 102 and/or progressive manager 120. As such, the progressive gaming data 114 can be determined by the progressive configurator 102 and/or progressive manager 120. Depending on the type of the progressive game (e.g., symbol-based, mystery-based) various operations can be performed to effectively manage a progressive game. Some exemplary operations are discussed below. Those skilled in the art will appreciate that the progressive manager 120 can be part of the progressive configurator 102 or vice versa. It should also be noted that progressive configuration data 108 and/or gaming data 112 can be provided as one or more parameters including static and dynamic parameters.

Figure 2:
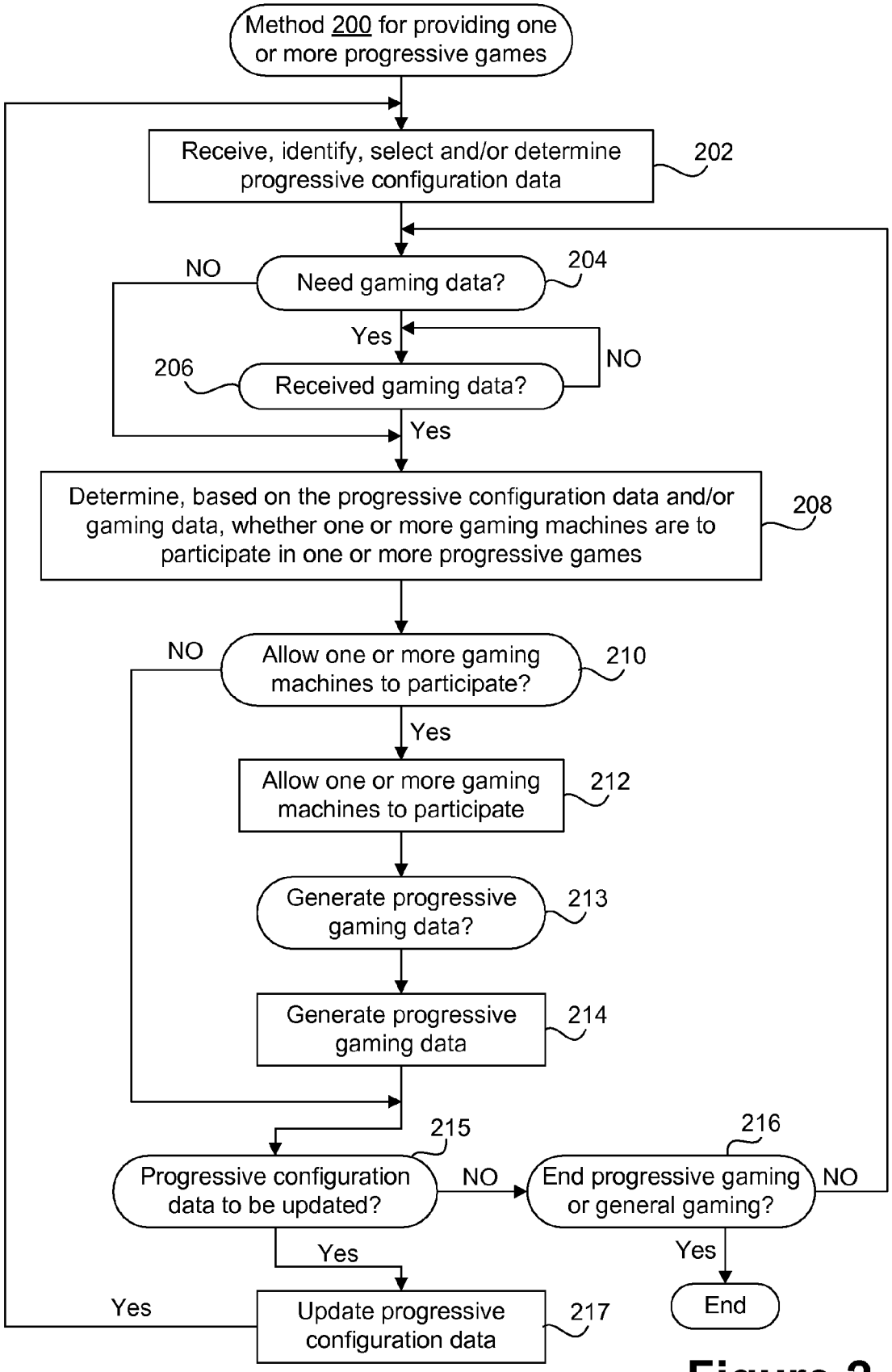
FIG. 2 depicts a method for providing one or more progressive games for a gaming environment in accordance with one embodiment of the invention.

FIG. 2 depicts a method 200 for providing one or more progressive games for a gaming environment in accordance with one embodiment of the invention. Initially, progressive configuration data is received, identified, selected and/or determined (202). Typically, the progressive configuration data is received as input (e.g., as a set of rules in an XSLT form). In any case, the progressive configuration data can effectively define one or more progressive games for the gaming environment. Next, it is determined (204) whether gaming data is needed. The gaming data can, for example, include information about one or more gaming machines, games available for play, gaming parameters, and/or data associated with an instance of game play. Gaming data can be received in order to determine whether one or more gaming machines are eligible to participate in a progressive game. This gaming data can, for example, be sent as static data parameters that effectively report the gaming machines capabilities and gaming parameters (e.g., parameters that indicate what games and denominations are available for play on the gaming machine). Additional gaming data relating to game play can also be received from one or more gaming machines. Typically, this additional gaming data is received from a gaming machine after it has been determined that the gaming machine is eligible to participate in a progressive game. Referring back to FIG. 2, if it is determined (204) that gaming data is needed, it is determined (206) whether the gaming data has been received. As such, the method 200 can effectively wait (206) to receive the gaming data. If it is determined (206) that the gaming data has been received, it is determined (208) whether one or more gaming machines are to participate in at least one progressive game. It should be noted that if it is determined (204) that no gaming data is needed, the method 200 directly proceed to determine (208) whether one or more gaming machines are to participate in one or more progressive games. As such, the determining (208) of whether one or more gaming machines are to participate in one or more progressive games can be made based on the progressive configuration data and/or based on the gaming data received (206). Accordingly, it is determined (210) whether to allow one or more gaming machines to participate in one or more progressive games. If it is determined (210) to allow one or more gaming machines to participate in one or more progressive games, one or more gaming machines are allowed (212) to participate in one or more progressive games by, for example, contributing to one or more progressive prizes and possibly winning them. Subsequently, it can be determined (213) whether to generate progressive data relating to the one or more progressive game. The progressive data can, for example, update progressive prizes and/or indicate a win and a winning prize to be awarded. As such, the progressive data can be generated (214) and, for example, provided to one or more gaming machines that have participated in playing one or more progressive games. Next, it is determined (215) whether the progressive data is to be updated. Those skilled in the art will appreciate that the progressive data can be updated, for example, to change the progressive games defined and/or define new progressive games. By way of example, an operator and/or system manager can edit one or more configuration files provided in an editable format. As such, progressive configuration data can be conveniently modified if needed when, for example, new games and/or gaming machines are added, new progressive games are made available, and/or older games and gaming machines are replaced. Furthermore, it will be appreciated that there is no need to change the configuration and/or affect the gaming operations of the gaming machines as progressive configuration data can be changed without changing the configuration of individual gaming machines or groups of gaming machines and disturbing the operations of the gaming machines. In effect, a gaming machine need not even know that it is part of a progressive game or network.

Referring back to FIG. 2, if it is determined (215) to update the progressive configuration data, the progressive configuration data is updated (217). Subsequently, progressive configuration data is received, identified, selected and/or determined (202) and the method proceeds in a same manner as described above. However, if it is determined (215) not to update the progressive configuration data, it is determined (216) whether to end the method 200. By way of example, input from an operator and/or administrator can effectively end progressive gaming operations for the gaming environment and/or the gaming environment can be shut down. If it is determined (216) not to end the method 200, it can be determined (204) whether gaming data is needed and the method 200 can proceed in a similar manner as described above. The method 200 ends when it is determined (216) to end the method 200.

Figure 3A:
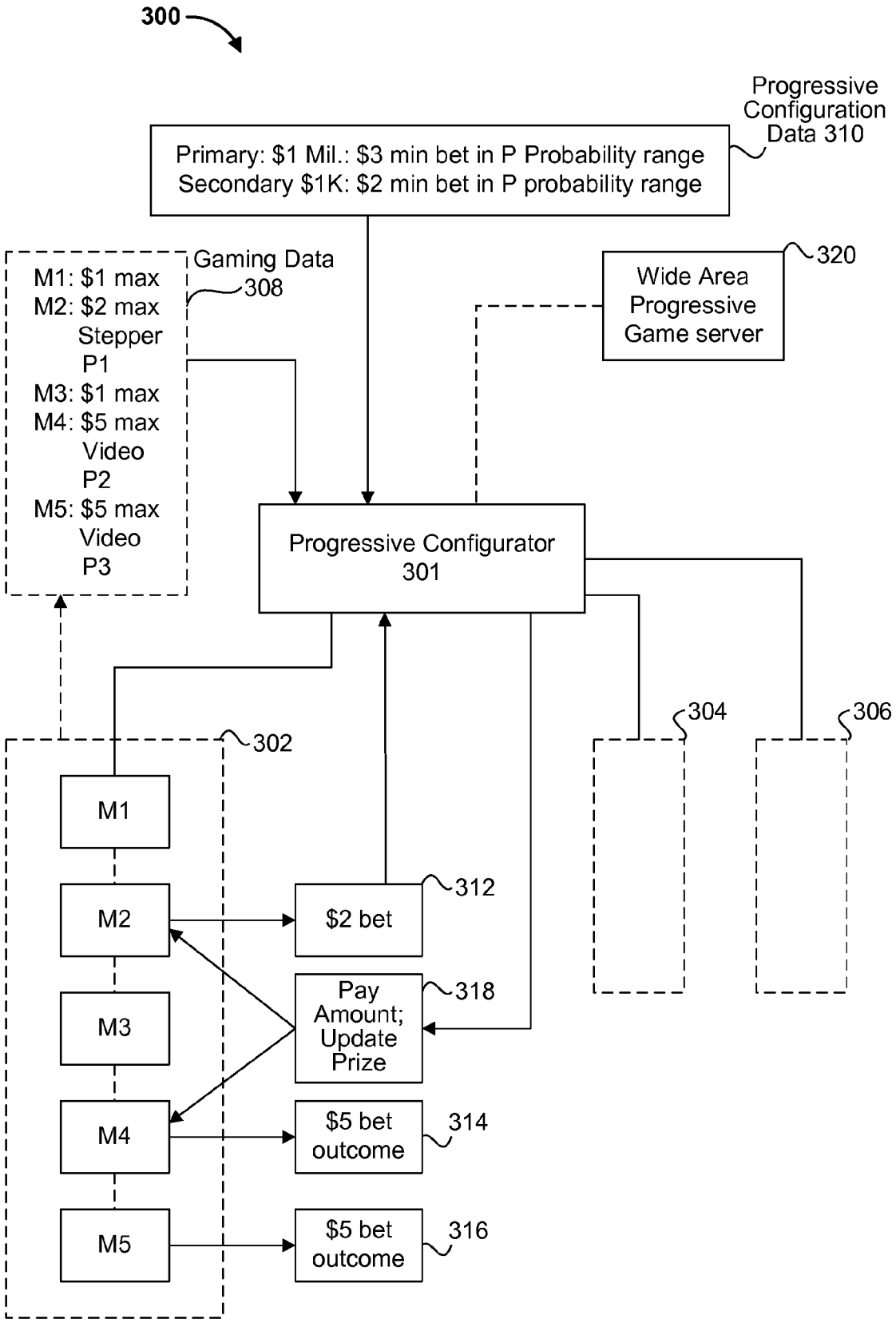
FIG. 3A depicts an exemplary computing environment in accordance with one embodiment of the invention.

To further elaborate, FIG. 3A depicts an exemplary computing environment 300 in accordance with one embodiment of the invention. Referring to FIG. 3A, a progressive configurator 301 can communicate with the banks or configurations 302, 304 and 306 of gaming machines. It will be appreciated that the banks 302, 304 and 306 can, for example, be on the same casino floor and/or network, or alternatively in different casinos, cities and/or countries. As such, the gaming machines can be manufactured and/or owned by the same or different entities. Referring back to FIG. 3A, the progressive configurator 301 can effectively implement one or more progressive games for the bank 302 of gaming machines. The bank 302 includes five (5) gaming machines M1, M2, M3, M4 and M5 that can be in communication with each other as well as in communication with the progressive configurator 301. As shown in FIG. 3A, gaming data 308 can be provided as input to the progressive configurator 301. The gaming data 308 can provide gaming machine specific information about the gaming machines M1, M2, M3, M4 and M5. The gaming data 308 can, for example, effectively describe information including the max bet (or betting amount), types of games available and the probabilities associated with each game available on each of the gaming machines in the bank 302 of the gaming machines M1, M2, M3, M4 and M5. By way of example, gaming machine M4 can be effectively described as having a $5 max bet for a video game with the probability P2 of success. Generally, the probability of a win can be very complex and include several values for different situations. However, for the sake of discussion, the probabilities P2 can be thought of as a single value assigned, for example, to a random event (e.g., a 50% chance of winning). For the sake of discussion, the progressive configuration data 310 can also be simplified. Referring to FIG. 3A, the progressive configuration data 310 can effectively describe a primary and a secondary progressive prize. More specifically, the progressive configuration data 310 can define a primary progressive prize of $1 million for minimum bets of $3 for games within a range of probabilities (e.g., probabilities of success between 40%-60%). It should be noted that in this example, any game can qualify. The secondary progressive prize can be effectively defined as a $1,000 prize for minimum bets of $2 in the probability range P.

It should be noted that the gaming data 308 can, for example, be sent by the gaming machines M1, M2, M3, M4 and M5 to the progressive configurator 301 and/or effectively obtained by the progressive configurator 301. The progressive configuration data 310 can, for example, be provided by an administrator and/or transformed into a set of rules (e.g., as a set of rules in an XSLT form or format). In any case, the gaming data 308 and progressive configuration data 310 can effectively be provided as input to the progressive configurator 301 which can use the information to effectively implement a progressive game. By way of example, based on the gaming data 308, the progressive configurator 301 can determine that the gaming machines M2, M4 and M5 may be eligible to participate in the progressive game effectively defined by the progressive configuration data 310. This means that the gaming machines M1 and M3 may not participate because their maximum betting amount (or max bet B1) is below the minimum required amount ($2) for the secondary progressive prize. However, a bet made for at least $2 on the gaming machines M2, M4 and M5 for a game within the P probability range can contribute to the primary and/or secondary progressive prizes and possibly win them. In other words, the probabilities P1, P2 and P3 associated with each of the gaming machines M1, M4 and M5 can be considered by the progressive configurator 301 in order to determine eligibility. Assuming that the probabilities P1, P2 and P3 are all within the acceptable range (P), gaming machines M2, M4 and M5 are eligible for the primary and secondary progressive prizes effectively defined by the progressive configuration data 310. As such, additional gaming data 312, 314, 316 can be provided to the progressive configurator 301 in order to determine whether a gaming instance played on one of the gaming machines M2, M4 and M5 can effectively participate in the progressive game defined by the progressive configuration data 310. By way of example, when a wager (e.g., $2) has been placed during game play on the gaming machine M2, the gaming machine M2 can send the gaming data 312, including the amount of wager, to the progressive configurator 301 in order to inform the progressive configurator 301 that a wager has been made. The progressive configurator 301 can then determine whether the wager qualifies for the primary and/or the secondary progressive prize. By way of example, a $2 bet on the gaming machine M2 can contribute to the secondary progressive prize and a $5 bet can contribute to the primary progressive prize and possibly to the secondary progressive prize depending on the gaming rules, regulation and/or preferences.

In addition to the amount of wager ($2), the gaming data 312 can provide additional data about the game including the outcome of the game (e.g., win or lose indication, actual or specific outcome of the game). In general, the outcome of the game can be determined by a gaming machine, another entity (e.g., gaming server) and/or the progressive configurator 301. Similarly, the determination of whether a progressive payout should be made can be determined by the progressive configurator 301 and/or another entity, for example, a wide area progressive game server 320 that is in communication with the progressive configurator 301. Depending on the result of the progressive game, progressive configurator 301 can receive and/or determine progressive gaming data 318 which can, for example, indicate a pay amount and/or provide updates for the progressive game and/or prize (e.g., provide an update for what the current value of the prize is). The progressive configurator 301, wide area progressive game server 320 and/or another entity (e.g., a progressive manager not shown) can effectively manage the progressive games by providing services that include accounting and administrative functions.

Figure 3B:
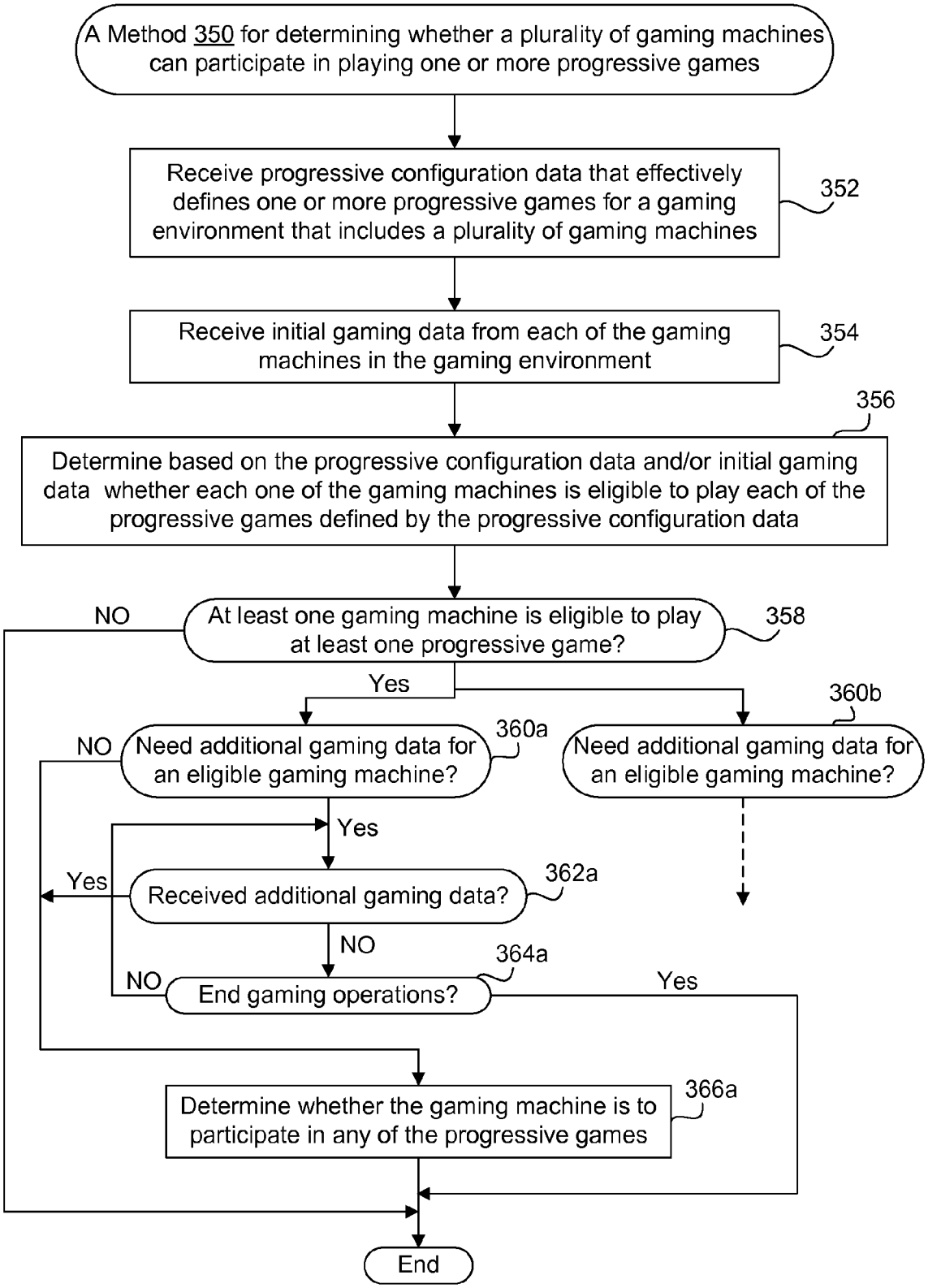
FIG. 3B depicts a method for determining whether one or more gaming machines are to participate in one or more progressive games provided in a gaming environment.

FIG. 3B depicts a method 350 for determining whether one or more gaming machines are to participate in one or more progressive games provided in a gaming environment. The one or more gaming machines are configured in the gaming environment and each one is operable for playing one or more games. Initially, progressive configuration data is received (352). The progressive configuration data effectively defines one or more progressive games that are to be provided for the gaming environment. Next, initial gaming data is received (354) from each one of the one or more gaming machines in the gaming environment. The initial gaming data can include data parameter related to the gaming machines and the games available on them. Subsequently, it is effectively determined (356) whether each one the gaming machines is eligible to play each one of the one or more progressive games defined by the progressive configuration data. This determination (356) can be made based on the progressive configuration data and/or the initial gaming parameters received from each of the gaming machines. In effect, one or more gaming machines can be identified as being eligible to participate in one or more progressive games. Accordingly, it is determined (358) whether at least one gaming machine is eligible to play at least one progressive game. If it is determined (358) that no gaming machine is eligible to play at least one progressive game, the method 350 ends. However, if it is determined (358) that at least one gaming machine is eligible to play at least one progressive game, it is determined (360*a*) whether additional gaming data is need for the one or more gaming machines eligible to play one or more progressive games defined by the progressive configuration data. Typically, this additional data is related to an actual game instance when a bet is placed and a game is played. As such, this data can be provided in real time when the game is being played. Additional data can, for example, include data identifying the amount of a bet, the result of a bet, and so on. It should be noted that a separate process for each gaming machine can be started (360*a*-*b*). However, for simplicity, only process 360*a* is discussed. If it is determined (360*a*) that no additional data is needed, it is determined (366*a*) whether the gaming machine can participate in any one of the progressive games and the method 350 ends. On the other hand, if it is determined (360*a*) that additional data is needed, it is determined (362*a*) where the additional data has been received. In effect, the method 200 or one of its processes can wait to receive the additional data. The method 200 or one of its processes can end if it is determined (364*a*) to end progressive gaming, for example, as a result of a time out or a decision to end the progressive gaming operations and/or the gaming operations in general. If it is determined (362*a*) that the additional data is received, it is determined (366*a*) whether the gaming machine can participate in any one of the progressive games and the method 350 ends.

Figure 4:
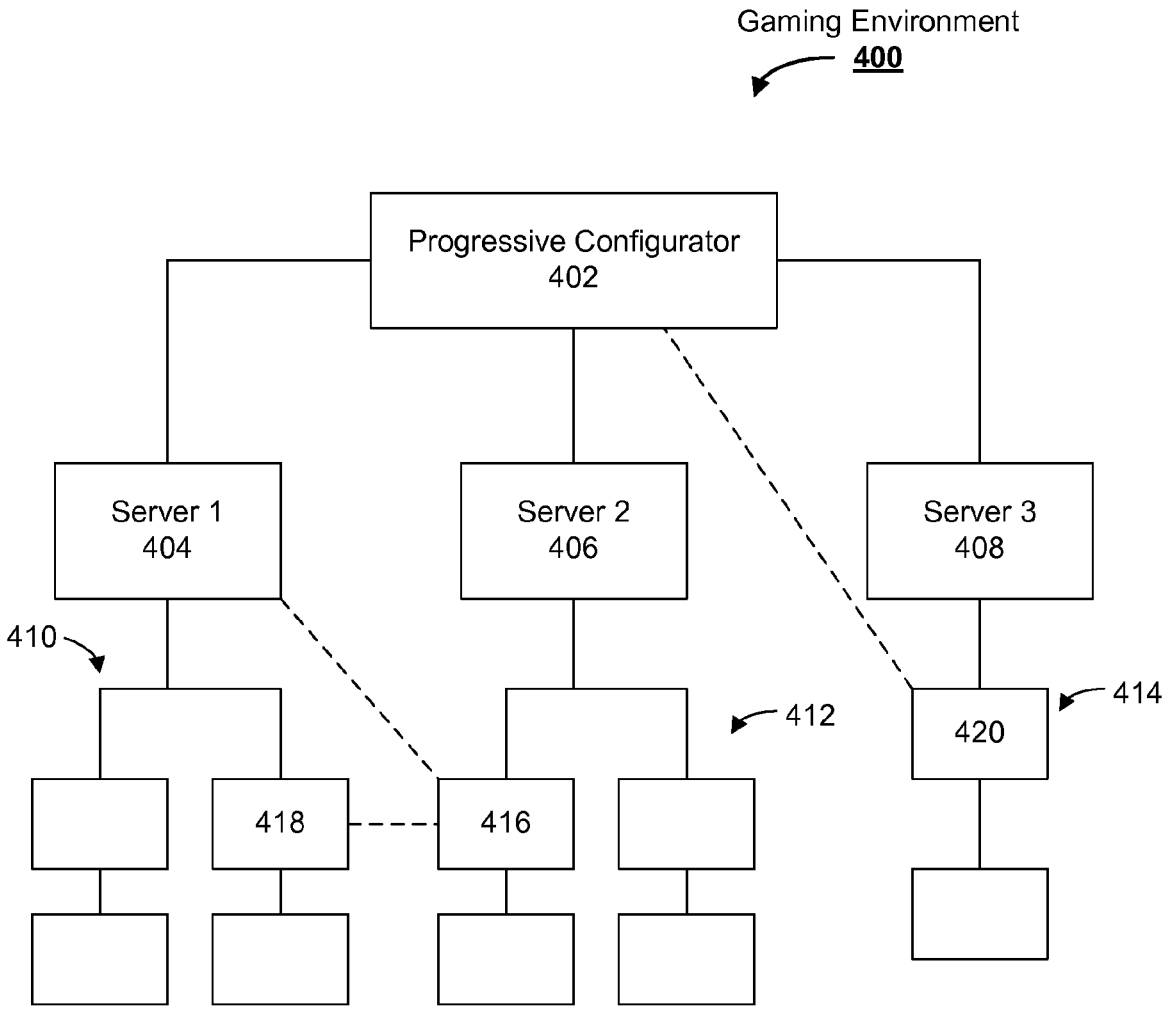
FIG. 4 depicts a gaming environment in accordance with one embodiment of the invention.

FIG. 4 depicts a gaming environment 400 in accordance with one embodiment of the invention. Referring to FIG. 4, a progressive configurator 402 is in communication with servers 404, 406 and 408. The gaming servers 404, 406 and 408 can, for example, be owned, operated and/or manufactured by different entities and/or placed in different casinos, cities (e.g., each gaming server can be owned and operated by a different casino in a different location). In addition, each of the servers 404, 406 and 408 can effectively communicate with a bank (or configuration) of gaming machines.

Referring to FIG. 4, the gaming server 404, 406 and 408 respectively serve the configuration 410, 412 and 414 of gaming machines. It should be noted that each of the gaming machines in a bank or configuration can be owned, operated and/or manufactured by a different entity. In addition, a gaming machine 416 in the bank 412 of gaming machines can, for example, be configured to communicate with the server 404 associated with a different bank of gaming machines (410). The gaming machine 416 can also be configured to directly communicate with a gaming machine 418 in a different bank of gaming machines (410). In any case, the progressive configurator 402 can effectively implement one or more progressive games for the gaming environment 400. More particularly, the progressive configurator 402 can communicate directly and/or via the servers 404, 406 and 408 with the gaming machines. By way of example, the progressive configurator 402 can be configured to directly communicate with the gaming machine 420 in the bank 414 of gaming machines and/or effectively use the server 408 to communicate with the gaming machine 420. In any case, the progressive configurator 402 can effectively implement one or more progressive games, using, for example, the techniques described above.

Figure 5:
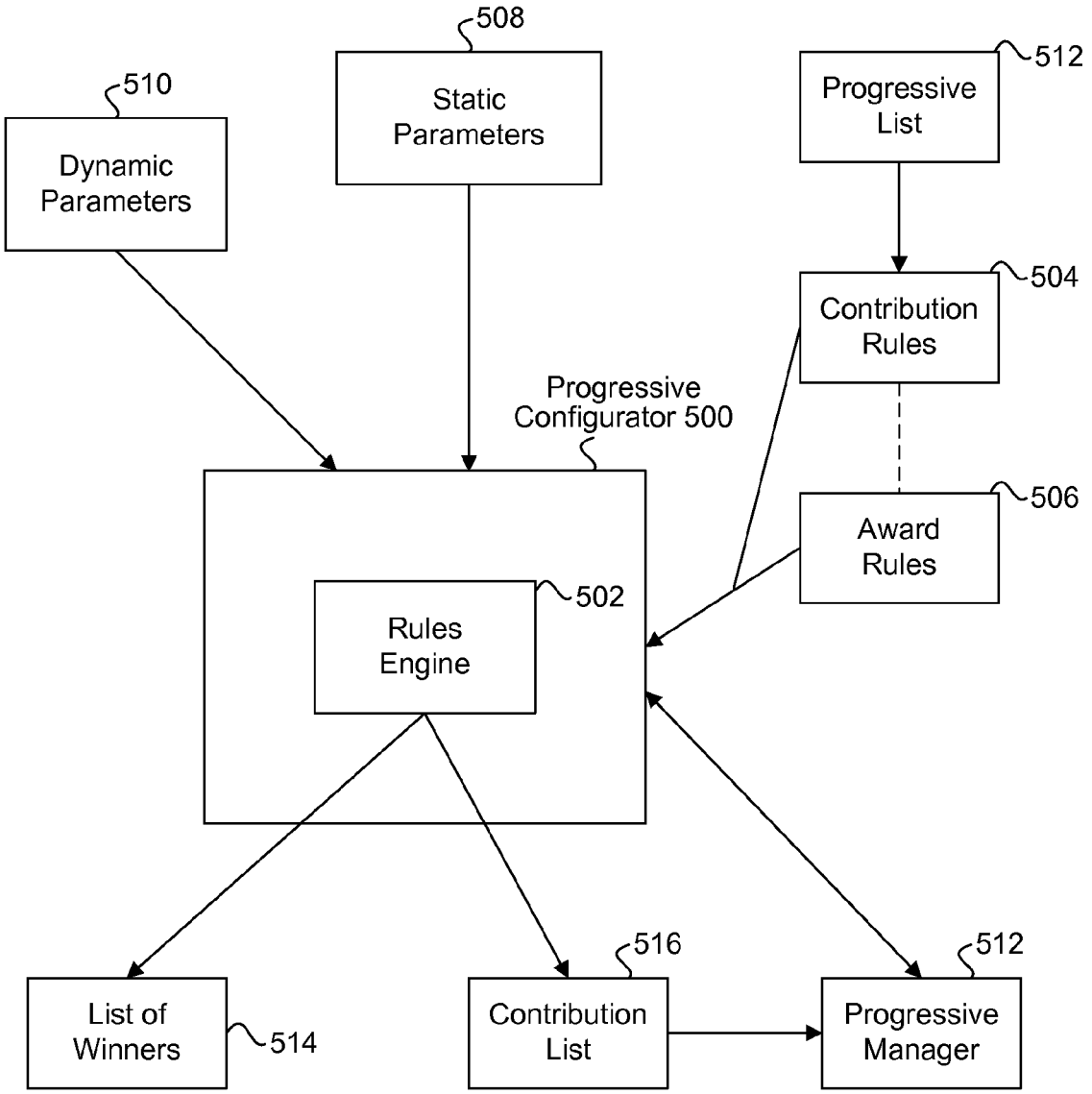
FIG. 5 depicts a progressive configurator in accordance with one embodiment of the invention.

FIG. 5 depicts a progressive configurator 500 in accordance with one embodiment of the invention. Those skilled in the art will appreciate that the progressive configurator 500 can be implemented using one or more hardware and/or software components (or modules). Conceptually, the progressive configurator 501 can include a rules engine 502 for processing progressive configuration data provided as contribution rules 504 and award rules 506. In addition, the rules engine 502 can receive and process static parameters 508 and dynamic parameters 510. Configuration and award rules 504 and 506 can be associated with one or more progressive games and effectively define contribution and award levels for them. The contribution and award rules 504 and 506 can, for example, be determined based on a progressive list or list of progressives 512 compiled for a gaming environment. The rules engine 502 can effectively determine whether a game instance is eligible and can contribute to a progressive prize. The rule engine 502 and/or the progressive manager 512 can determine whether a game instance is a winner of a progressive prize. Typically, administrative and/or managerial functions are performed by the progressive manager 512 which can be in communication with the progressive configurator 500. The rule engine 502 can also generate progressive gaming data associated with one or more progressive games. Referring to FIG. 5, exemplary progressive gaming data 514 and 516 are depicted. More particularly, for mystery progressives where a progressive award can be generated without a player knowing what event or condition would result in a win, a list of winners 514 can be generated. The list of winners 514 can identify a game instance that is a winner of a mystery progressive. In addition, a contribution list 516 can be generated for mystery progressives. The contribution list 516 can also identify contribution levels for symbol-based progressives where a particular winning event, condition or outcome is known to be a winner of a mystery prize (e.g., a poker hand with four aces can be designated as a winner of a progressive prize). The contribution list 516 can be generated based on contribution rules 504 and provided as input to a progressive manager 512 which manages the progressive game. The progressive manager 512 and/or progressive configurator 500 can effectively provide updates of the progressive prizes. In general, a gaming machine can be updated with information related to one or more progressive games.

Figure 6A:
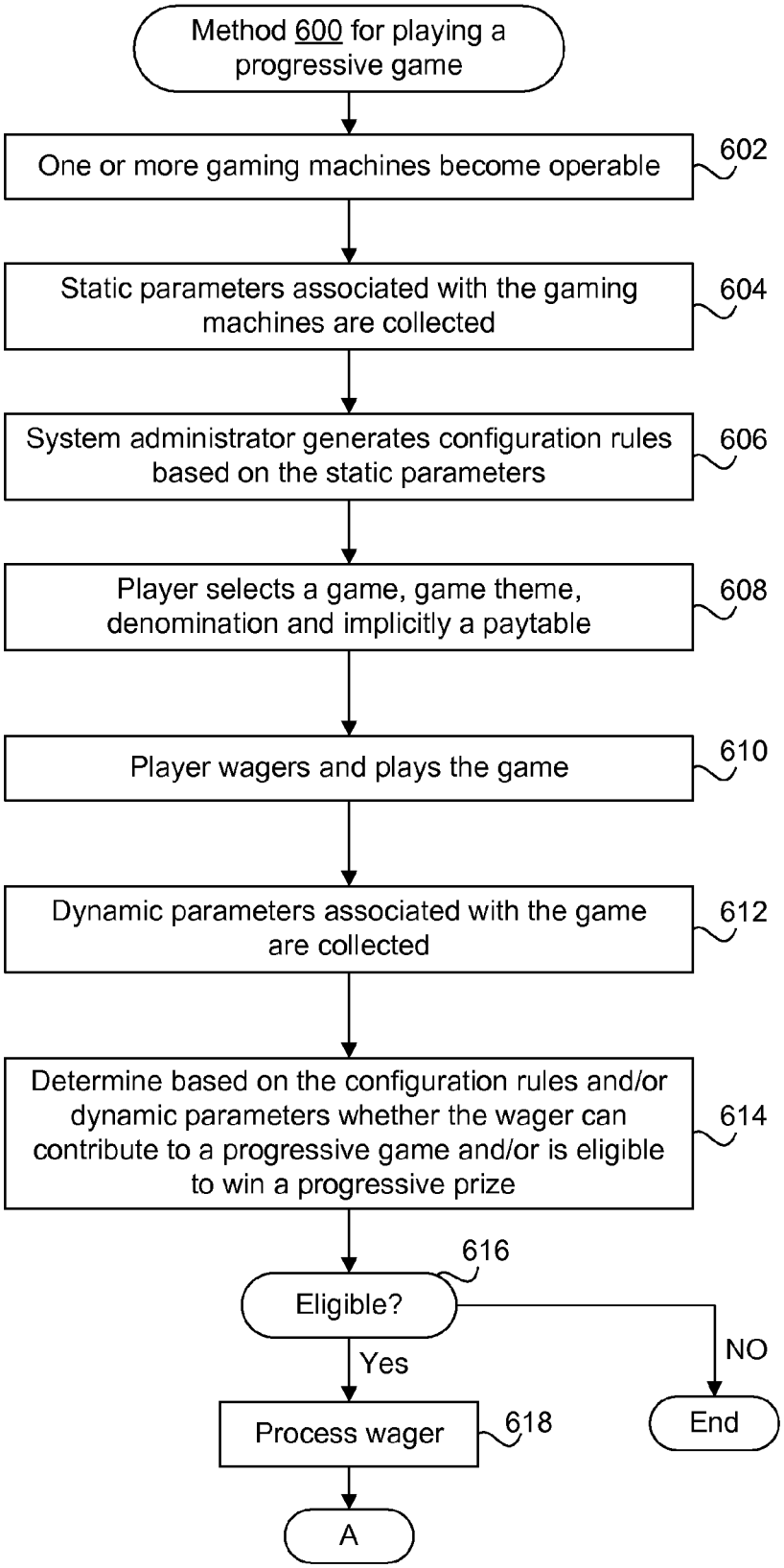
FIGS. 6A and 6B depict a method for playing a progressive game in a gaming environment in accordance with one embodiment of the invention.
Figure 6B:
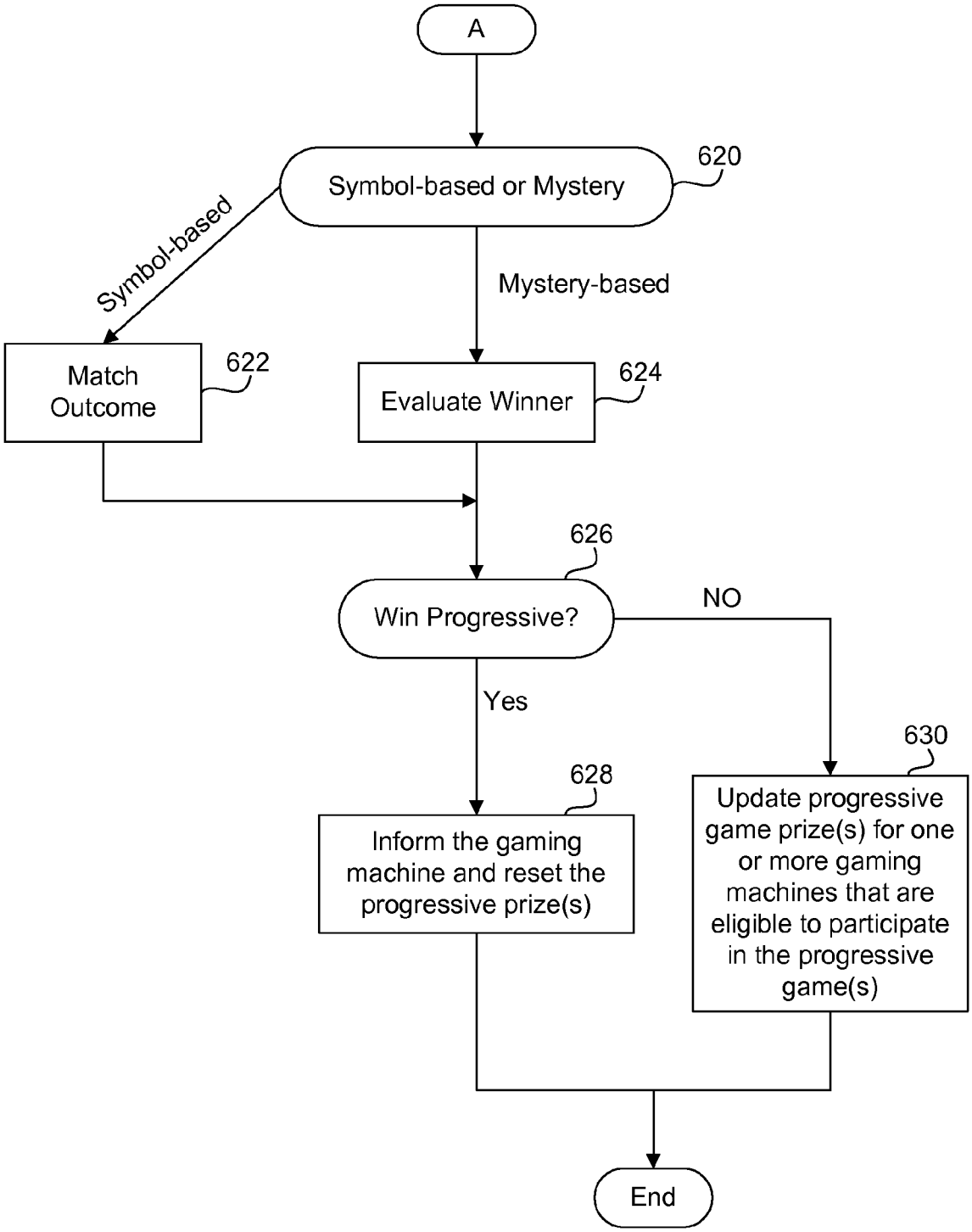

FIGS. 6A and 6B depict a method 600 for playing a progressive game in a gaming environment in accordance with one embodiment of the invention. Initially, one or more gaming machines become operable (602) for playing one or more games in the gaming environment. Next, static parameters associated with the one or more gaming machines are collected (604). By way of example, the static parameters can include name and/or serial number of a gaming machine, games currently available on the gaming machine and other information associated with the gaming machine and/or games available on the gaming machine (e.g., denomination, max bet). After static parameters have been collected (604), a system administrator effectively generates (606) progressive configuration rules based on the static parameters. Next, a player selects (608) a game, game theme, denomination and implicitly a pay table. Subsequently, the player wagers and plays (610) the game. As a result, dynamic parameters associated with the game can be collected (612). By way of example, the dynamic parameters can include actual amount of the wager placed, the outcome of the game, and other player information. Thereafter, based on the configuration rules and/or dynamic parameters, it is determined (614) whether the wager can contribute to a progressive game and/or is eligible to win a progressive prize. Accordingly, if it is determined (616) that the wager is not eligible for contribution to any progressive games, the method 600 ends. It will be appreciated that the method 600 can be implemented to effectively wait for additional games instance, but for simplicity a single game instance is depicted. If it is determined (616) that the wager is eligible to contribute to at least one progressive game and/or win a progressive prize, the wager is processed (618). The wager can be processed as a contribution to one or more progressive games.

Referring now to FIG. 6B, depending on whether a progressive game is symbol-based or mystery-based, various operations can be performed. For simplicity only one instance of a decision (620) is shown for determining whether a progressive game is symbol-based or a mystery-based game. However, those skilled in the art will readily appreciate that the decision (620) can be repeated as many times as necessary. Furthermore, it will be appreciated that the operations (622) and (624) are exemplary operations and other operations can be performed instead or in addition to matching (622) the outcome of a symbol-based game to a win category and evaluating (624) whether there is a win or winner for a mystery-based progressive game. Referring again to FIG. 6B, it is determined (626) whether there is a win for a progressive game. If it is determined (626) that there is a win, a gaming machine can be effectively informed (628) that there is a win and one or more progressive prizes can be reset accordingly. If it is determined (626) that there is no win, one or more progressive game prizes can be updated for one or more gaming machines that are eligible to participate in playing the one or more progressive games. It should be noted that operations (628) can (630) are exemplary operations that can be performed depending on whether there is a progressive winner. As such, other operations including those associated with management and bookkeeping of the prizes can be performed instead or in addition to those shown. In any case, method 600 can end following either one of the operations 628 and 630.

FIGS. 7A and 7B depict exemplary progressive rules in accordance with one embodiment of the invention. Referring to FIG. 7A, a first portion 702 of rules effectively defines a progressive game for any Wheel of Fortune game in a particular gaming configuration, namely, "Vland," which has a $1 denomination. In particular, the first portion of rules 702 provides that any $1 denomination for a group of Wheel of Fortune games contributes to a progressive game and can win a scaled Jackpot. Similarly, a second portion 704 of rules effectively defines a progressive game with primary and secondary prizes. Those skilled in the art will appreciate that progressive rules can effectively define a wide variety of progressive games and/or prizes in accordance with the techniques discussed above.

Figure 8:
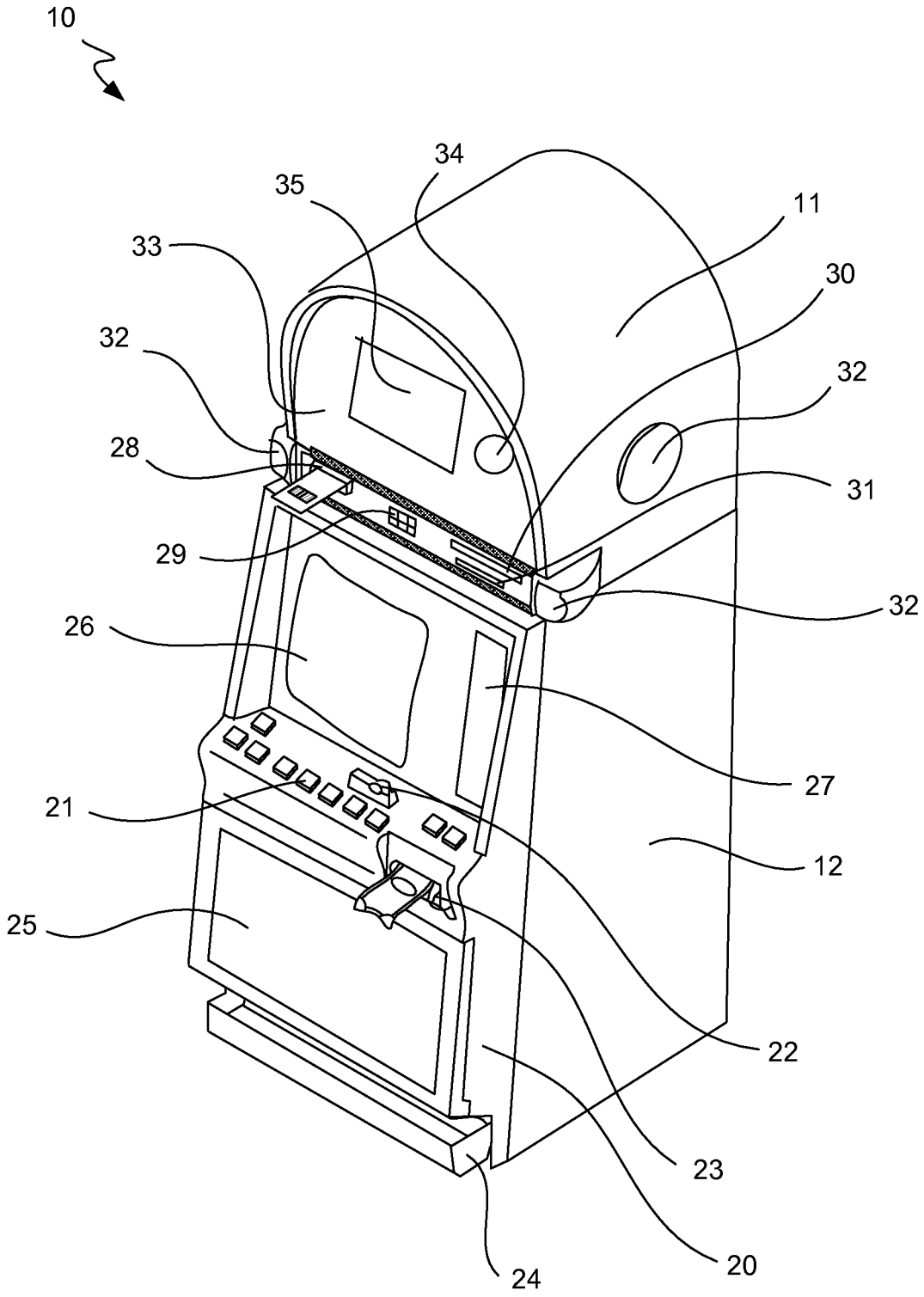
FIG. 8 illustrates in perspective view an exemplary gaming machine.

Referring to FIG. 8, an exemplary gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, one or more money or credit acceptors, such as a coin acceptor 22 and a bill or ticket validator 23, a coin tray 24, and a belly glass 25. Viewable through main door 20 is a primary video display monitor 26 and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket dispenser 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display. It will be understood that many makes, models, types and varieties of gaming machines exist, that not every such gaming machine will include all or any of the foregoing items, and that many gaming machines will include other items not described above.

With respect to the basic gaming abilities provided, it will be readily understood that gaming machine 10 can be adapted for presenting and playing any of a number of gaming events, particularly games of chance involving a player wager and potential monetary payout, such as, for example, a wager on a sporting event or general play as a slot machine game, a keno game, a video poker game, a video blackjack game, and/or any other video table game, among others. Other features and functions may also be used in association with gaming machine 10, and it is specifically contemplated that the present invention can be used in conjunction with such a gaming machine or device that might encompass any or all such additional types of features and functions. One item that is specifically contemplated for use with the present invention involves a gaming machine that incorporates a reusable cashless instrument feature, such as a reusable cashless instrument issuing device and/or a reusable cashless instrument reading device.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage-monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security-monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents is a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

Figure 9:
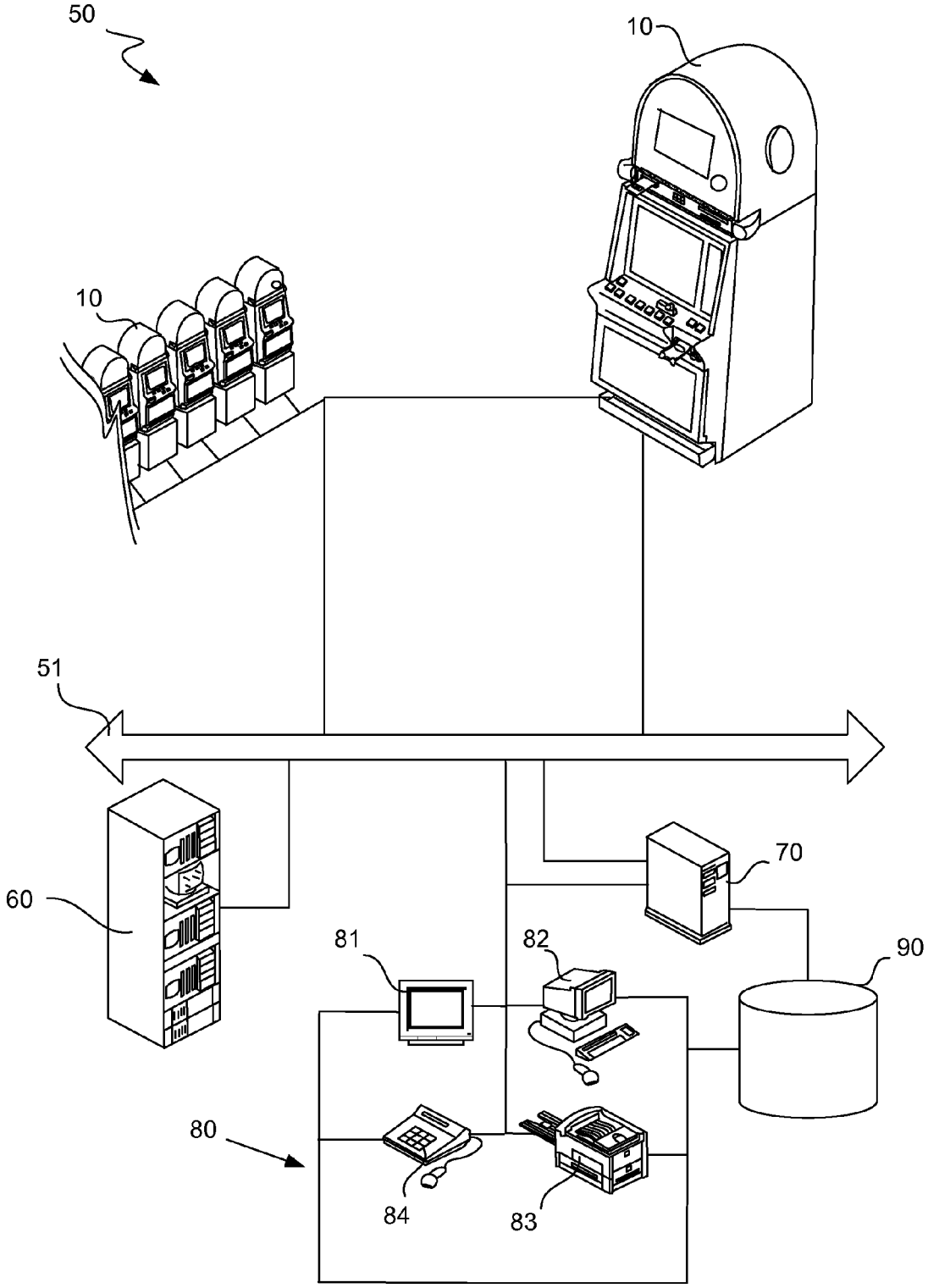
FIG. 9 illustrates in block diagram format an exemplary network infrastructure.

Turning now to FIG. 9, an exemplary network infrastructure for providing a gaming system having one or more gaming machines is illustrated in block diagram format. Exemplary gaming system 50 has one or more gaming machines, various communication items, and a number of host-side components and devices adapted for use within a gaming environment. As shown, one or more gaming machines 10 adapted for use in gaming system 50 can be in a plurality of locations, such as in banks on a casino floor or standing alone at a smaller non-gaming establishment, as desired. Common bus 51 can connect one or more gaming machines or devices to a number of networked devices on the gaming system 50, such as, for example, a general-purpose server 60, one or more special-purpose servers 70, a sub-network of peripheral devices 80, and/or a database 90.

A general-purpose server 60 may be one that is already present within a casino or other establishment for one or more other purposes beyond any monitoring or administering involving gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to cashless gaming administration, player tracking operations, specific player account administration, remote game play administration, remote game player verification, remote gaming administration, downloadable gaming administration, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 50 contains one or more special-purpose servers that can be used for various functions relating to the provision of cashless gaming and gaming machine administration and operation under the present methods and systems. Such a special-purpose server or servers could include, for example, a cashless gaming server, a player verification server, a general game server, a downloadable games server, a specialized accounting server, and/or a visual image or video distribution server, among others. Of course, these functions may all be combined onto a single specialized server. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 50 can be isolated from any other network at the establishment, such that a general-purpose server 60 is essentially impractical and unnecessary. Under either embodiment of an isolated or shared network, one or more of the special-purpose servers are preferably connected to sub-network 80, which might be, for example, a cashier station or terminal. Peripheral devices in this sub-network may include, for example, one or more video displays 81, one or more user terminals 82, one or more printers 83, and one or more other input devices 84, such as a ticket validator or other security identifier, among others. Similarly, under either embodiment of an isolated or shared network, at least the specialized server 70 or another similar component within a general-purpose server 60 also preferably includes a connection to a database or other suitable storage medium 90. Database 90 is preferably adapted to store many or all files containing pertinent data or information regarding cashless instruments such as tickets, among other potential items. Files, data and other information on database 90 can be stored for backup purposes, and are preferably accessible at one or more system locations, such as at a general-purpose server 60, a special purpose server 70 and/or a cashier station or other sub-network location 80, as desired.

While gaming system 50 can be a system that is specially designed and created new for use in a casino or gaming establishment, it is also possible that many items in this system can be taken or adopted from an existing gaming system. For example, gaming system 50 could represent an existing cashless gaming system to which one or more of the inventive components or program modules are added. In addition to new hardware, new functionality via new software, modules, updates or otherwise can be provided to an existing database 90, specialized server 70 and/or general-purpose server 60, as desired. In this manner, the methods and systems of the present invention may be practiced at reduced costs by gaming operators that already have existing gaming systems, such as an existing EZ Pay® or other cashless gaming system, by simply modifying the existing system. Other modifications to an existing system may also be necessary, as might be readily appreciated.

The various aspects, features, embodiments or implementations of the invention described above can be used alone or in various combinations.

The many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A computing system for providing one or more progressive games for a gaming environment that includes one or more gaming machines operable for playing one or more games, wherein said computing system comprises one or more processors and one or more memories, the one or more processors and the one or more memories operably connected, and wherein the computing system is configured to:

identify progressive configuration data for at least one progressive game for said gaming environment, the progressive configuration data comprising requirements for participation in said at least one progressive game, wherein the progressive configuration data is in an XSLT format;

receive initial gaming data associated with said one or more gaming machines from said one or more gaming machines, wherein said initial gaming data includes gaming capabilities and gaming parameters of said gaming machines including at information indicating an outcome probability for a game offered on said one or more gaming machines, and wherein the initial gaming data is in an XML format;

determine whether said one or more gaming machines is to participate in said at least one progressive game based on whether the received outcome probability included in the initial gaming data meets the requirements of said progressive configuration data; and allow said one or more gaming machines to participate in said at least one progressive game if it is determined that the received outcome probability included in the initial gaming data meets the requirements of said progressive configuration data.

2. A computing system for providing one or more progressive games for a gaming environment that includes one or more gaming machines operable for playing one or more games, wherein said computing system comprises one or more processors and one or more memories, the one or more processors and the one or more memories operably connected, and wherein the computing system is configured to:

identify progressive configuration data for at least one progressive game for said gaming environment, the progressive configuration data comprising requirements for participation in said at least one progressive game;

receive initial gaming data associated with said one or more gaming machines from said one or more gaming machines, wherein said initial gaming data includes gaming capabilities and gaming parameters of said gaming machines including at least one of: information indicating which games are available for play on said one or more gaming machines, information indicating denominations available on said one or more gaming machines, information indicating a minimum allowed wager for a game offered on said one or more gaming machines, information indicating a maximum allowed wager for a game offered on said one or more gaming machines, and information indicating an outcome probability for a game offered on said one or more gaming machines;

determine whether said one or more gaming machines is to participate in said at least one progressive game based on whether the received initial gaming data meets the requirements of said progressive configuration data; and allow said one or more gaming machines to participate in said at least one progressive game if it is determined that the received initial gaming data meets the requirements of said progressive configuration data, wherein said initial gaming data is provided in an XML form, and said progressive configuration data is provided in an XSLT form.

3. A computing system as recited in claim 2, wherein said initial gaming data is received from said one or more gaming machines, and wherein said one or more gaming machines are not internally configured to participate in said at least one progressive game.

4. A computing system as recited in claim 2, wherein said initial gaming data includes data associated with a first game instance for a first game played on a first gaming machine.

5. A computing system as recited in claim 2, wherein said computing system is further configured to:

select progressive gaming data associated with said at least one progressive game; and send said progressive gaming data to said one or more gaming machines.

6. A computing system as recited in claim 2, wherein said progressive gaming data is received from a progressive manager that manages said at least one progressive game for said gaming environment.

7. A computing system as recited in claim 6, wherein said progressive gaming data includes one or more of the following:

a result which includes at least one of a win or a lose indication for said at least one progressive game and an update for or reset of one or more progressive prizes associated with said at least one progressive game.

8. A computing system as recited in claim 2, wherein said progressive configuration data defines one or more progressive prizes for said at least one progressive game.

9. A computing system as recited in claim 2, wherein said progressive configuration data is provided by an administrator of said gaming environment.

10. A computing system as recited in claim 2, wherein said computer system is further configured to identify updated progressive configuration data as an update to said progressive configuration data, wherein said updated progressive configuration data modifies a definition of said at least one progressive game or defines at least one other progressive game for said gaming environment.

11. A computing system as recited in claim 10, wherein said computing system acts as a gaming server to said one or more gaming machines in said gaming environment.

12. A computing system as recited in claim 2, wherein said computing system is further configured to:

determine whether said initial gaming data is needed to determine whether a first gaming machine of said one or more gaming machines is to participate in said at least one progressive game; and receive said initial gaming data from said first gaming machine when a first game instance is played on said gaming machine.

13. A gaming server for providing one or more progressive games for one or more gaming machines operable for playing one or more games in a gaming environment, wherein said gaming server comprises one or more processors and one or more memories, the one or more processors and the one or more memories operably connected, and wherein the computing system is configured to:

identify progressive configuration data defining at least one progressive game for said gaming environment, the progressive configuration data comprising requirements for participation in said at least one progressive game, wherein the progressive configuration data is in an XSLT format;

receive initial gaming data associated with said one or more gaming machines from said one or more gaming machines, wherein said initial gaming data includes information indicating an outcome probability for a game offered on said one or more gaming machines, and wherein the initial gaming data is in an XML format; and determine based on whether said received outcome probability included in the initial gaming data meets said requirements of said progressive configuration data whether said one or more gaming machines is eligible to participate in said at least one progressive game defined by said progressive configuration data.

14. A gaming server as recited in claim 13, wherein said gaming server is further configured to:

determine a progressive result that indicates whether a first instance of a first game is a winner of said at least one progressive game.

15. A gaming server as recited in claim 14, wherein said gaming server is further configured to perform one or more of the following:

determine a progressive contribution amount that indicates the contribution amount of said first instance of said first game to one or more progressive prizes associated with said at least one progressive game; and determine one or more progressive prize amounts that indicate the prize amounts associated with said at least one progressive game to be awarded as the result of playing said first game when said progressive game result indicates that said first instance of said first game is a winner of said at least one progressive game.

16. A gaming server as recited in claim 15, wherein said progressive contribution amount and said progressive prize amounts are received from a progressive game manager that at least contributes to managing said at least one progressive game in said gaming environment.

17. A gaming server as recited in claim 13, wherein said gaming server is further configured to:

receive progressive gaming data for said at least one progressive game; and send said progressive gaming data to a first gaming machine.

18. A gaming server as recited in claim 17, wherein said progressive gaming data includes one or more of the following: a list of winners and a contribution list.

19. A gaming server as recited in claim 13, wherein said progressive configuration data includes one or more of the following: a list of progressive game participants, contribution rules, and award rules.

20. A gaming server as recited in claim 13, wherein said progressive configuration data is generated based on said initial gaming data.

21. A gaming server as recited in claim 13, wherein said progressive configuration data is generated based on input provided by a human being to a computer system.

22. A gaming server as recited in claim 13, wherein said initial gaming data includes one or more dynamic parameters generated when a first game is played on a first gaming machine.

23. A computer-implemented method of providing one or more progressive games for a gaming environment that includes one or more gaming machines operable for playing one or more games, the gaming environment comprising one or more processors and one or more memories, the one or more processors and the one or more memories operably connected, said method comprising:

identifying, using the one or more processors, progressive configuration data that defines at least one progressive game for said gaming environment, the progressive configuration data comprising requirements for participation in said at least one progressive game, wherein the progressive configuration data is in an XSLT format;

receiving, at the one or more processors, initial gaming data associated with said one or more gaming machines from said one or more gaming machines, wherein said initial gaming data includes information indicating the gaming capabilities and gaming parameters of said one or more gaming machines including information indicating an outcome probability for a game offered on said one or more gaming machines, and wherein the initial gaming data is in an XML format;

determining, using the one or more processors, whether said one or more gaming machines is to participate in said at least one progressive game based on whether the received outcome probability included in the initial gaming data meets the requirements of said progressive configuration data; and allowing, using the one or more processors, said one or more gaming machines to participate in said at least one progressive game if it is determined that the received outcome probability included in the initial gaming data meets the requirements of said progressive configuration data.

24. A non-transitory computer readable medium with computer program code stored thereon, the computer program code for providing one or more progressive games for a gaming environment that includes one or more gaming machines operable for playing one or more games, said computer readable medium having stored thereon:

computer program code for identifying progressive configuration data that defines at least one progressive game for said gaming environment, the progressive configuration data comprising requirements for participation in said at least one progressive game, wherein the progressive configuration data is in an XSLT format;

computer program code for receiving initial gaming data associated with said one or more gaming machines, wherein said initial gaming data includes information indicating the gaming capabilities and gaming parameters of said one or more gaming machines including information indicating an outcome probability for a game offered on said one or more gaming machines, and wherein the initial gaming data associated is in a an XML format;

computer program code for determining whether said one or more gaming machines is to participate in said at least one progressive game based on whether the received outcome probability included in the initial gaming data meets the requirements of said progressive configuration data; and computer program code for allowing said one or more gaming machines to participate in said at least one progressive game if it is determined that the received outcome probability included in the initial gaming data meets the requirements of said progressive configuration data.

25. A computing system for providing one or more progressive games for a gaming environment that includes one or more gaming machines operable for playing one or more games, wherein said computing system comprises one or more processors and one or more memories, the one or more processors and the one or more memories operably connected, and wherein the computing system is configured to:

identify progressive configuration data for at least one progressive game for said gaming environment, the progressive configuration data comprising requirements for participation in said at least one progressive game, wherein the progressive configuration data is in an XSLT format;

receive initial gaming data associated with said one or more gaming machines from said one or more gaming machines, wherein said initial gaming data includes gaming capabilities and gaming parameters of said gaming machines including at least one of: information indicating which games are available for play on said one or more gaming machines, information indicating denominations available on said one or more gaming machines, information indicating a minimum allowed wager for a game offered on said one or more gaming machines, information indicating a maximum allowed wager for a game offered on said one or more gaming machines, and information indicating an outcome probability for a game offered on said one or more gaming machines, and wherein the initial gaming data is in an XML format;

determine whether said one or more gaming machines is to participate in said at least one progressive game based on whether the received initial gaming data meets the requirements of said progressive configuration data; and allow said one or more gaming machines to participate in said at least one progressive game if it is determined that the received initial gaming data meets the requirements of said progressive configuration data, wherein said initial gaming data and progressive configuration data are provided at least partly in a language based on XML.

* * * * *